US005299399A

United States Patent [19]

Baier et al.

[11] Patent Number: 5,299,399

[45] Date of Patent: Apr. 5, 1994

[54] WINDOW PANEL WITH BREATHER SYSTEM

[75] Inventors: Bruce A. Baier; Bruce A. Hagemeyer; Merlan J. Rolffs; John W. Scharff, all of Pella, Iowa

[73] Assignee: Pella Corporation, Pella, Iowa

[21] Appl. No.: 793,475

[22] Filed: Nov. 18, 1991

[51] Int. Cl.[5] ..... E06B 7/12

[52] U.S. Cl. ..... 52/204.52; 52/209; 454/198; 454/243

[58] Field of Search ..... 52/171, 172, 302, 303, 52/304, 305, 209, 302.3, 302.7; 454/198, 211, 214, 243

[56] References Cited

U.S. PATENT DOCUMENTS 462,652 11/1891 Bury ..... 454/214
2,159,661 5/1939 Knudsen ..... 52/172
2,264,176 11/1941 Englehart et al. ..... 52/304
4,627,206 12/1986 Cox .
4,641,466 2/1987 Rahinen et al. ..... 52/209 X
4,656,803 4/1987 Chludil ..... 52/172 X

FOREIGN PATENT DOCUMENTS 1125046 10/1951 Finland ..... 52/177.2

*Primary Examiner*—Carl D. Friedman
*Assistant Examiner*—Robert Canfield
*Attorney, Agent, or Firm*—Zarley, McKee, Thomte, Voorhees & Sease

[57] ABSTRACT

A dual glazing window having a removable glazing panel is provided with a breather system connecting the air chamber between the glazing panels with the outside ambient air by routing an outwardly facing channel into the window rail or stile member either on its end edge or side face. The abutting rail or stile member will close the open side of the channel in the end edge while the adjacent glazing panel closes the channel in the side face. A breather sleeve is press fitted into the channel to protect the wood from absorbing moisture.

28 Claims, 3 Drawing Sheets

WINDOW PANEL WITH BREATHER SYSTEM

BACKGROUND OF THE INVENTION

Many windows are manufactured for high energy efficiency by utilizing dual glazing panels with an insulating air space therebetween. Typically, the interior glazing panel is removable. Such a design requires that the insulating air space be vented to the atmosphere to prevent excessive moisture build up which results in condensation on the glazing panels. Such ventilation is usually provided by drilling holes through the sash frame. An example of this is shown in U.S. Pat. No. 4,627,206. A pair of drilled interconnecting holes are illustrated in prior art FIG. 6.

A breather system is needed that involves a minimum number of manufacturing steps but is effective in venting the insulating air space.

SUMMARY OF THE INVENTION

The insulating air space between dual glazing panels is vented to the external ambient air through a channel produced by a single routing step in the manufacture of the window panel. The channel is routed into a face of the rail or stile members comprising the perimeter frame. The open channel is closed in one embodiment by engagement with one of the glazing panels. In an alternate embodiment the channel is formed in the end face of the stile or rail member and is closed by abutting engagement with the adjacent stile or rail member.

A breather sleeve may be inserted into the channel formed in the face of the stile or rail window frame members to protect the wood in the channel from absorbing moisture. In the case of the channel closed by the glazing panel, the sleeve is L-shaped and extends along the length of the channel and then outwardly along the peripheral edge of the glazing panel. The channel in this case is formed in the side face of the glazing stop portion of the rail or stile member.

DESCRIPTION OF PREFERRED EMBODIMENT

Figure 1:
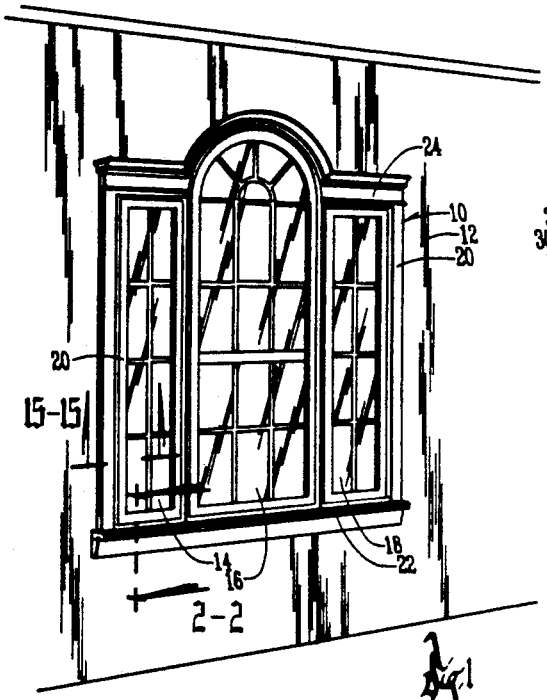
FIG. 1 is a fragmentary perspective view of a wall having a window assembly which includes the breather system of this invention.

A window assembly utilizing the breather system of this invention is referred to in FIG. 1 generally by the reference numeral 10 and is shown mounted in a wall 12. The window assembly 10 includes individual window panels 14, 16 and 18 mounted in a window opening frame which includes oppositely disposed stile frame members 20 and rail sill member 22 and rail head member 24.

The window panel 14 is seen to include a bottom rail 26 having a glass stop 28 engaging an outer dual insulated glass glazing panel 30. The glazing panel 30 with a removable glazing panel 32 define an insulating air chamber 34 therebetween. The removable panel 32 engages the rail stop portion 28 on the opposite side from glazing panel 30. Metal cladding which functions as a glazing retainer 36 engages the outer face of the glazing panel 30.

Figure 5:
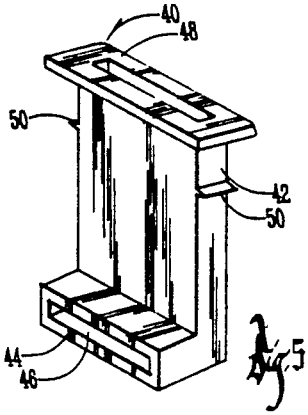
FIG. 5 is a perspective view of an L-shaped breather sleeve.
Figure 6:
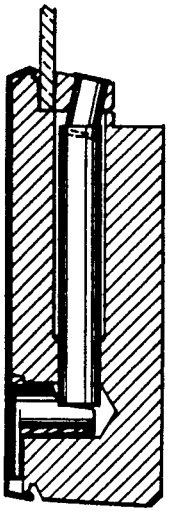
Fig.6 ( PRIOR ART )
FIG. 6 is a cross sectional view of a prior art breather system in a window panel.

The rail stop 28 has a U-shaped channel 38 formed in the face engaging the glazing panel 30. An L-shaped breather sleeve 40 as seen in FIG. 5 is press fitted into the U-shaped channel 38.

Figure 2:
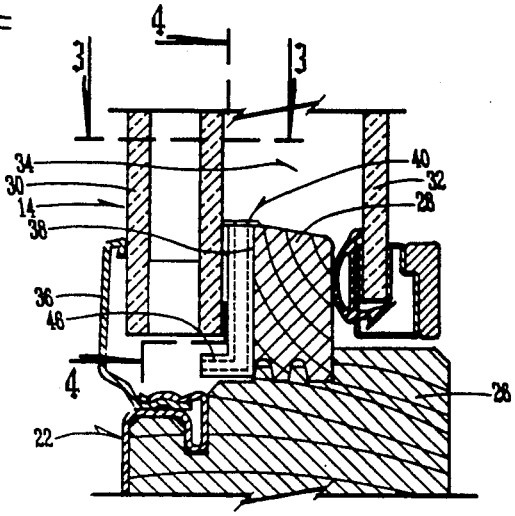
FIG. 2 is a cross sectional view taken along line 2—2 in FIG. 1.
Figure 3:
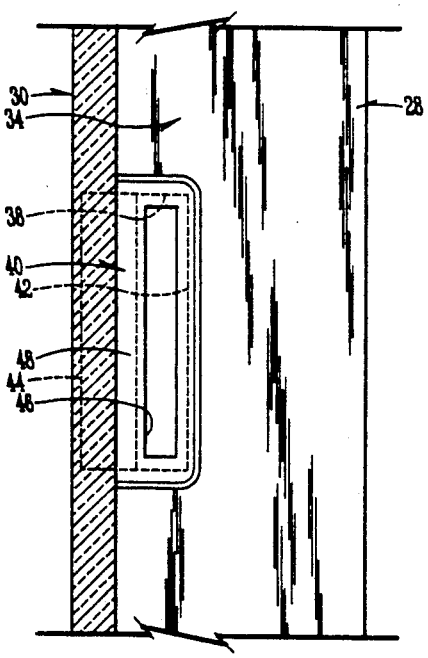
FIG. 3 is an enlarged cross sectional view taken along line 3—3 in FIG. 2.
Figure 4:
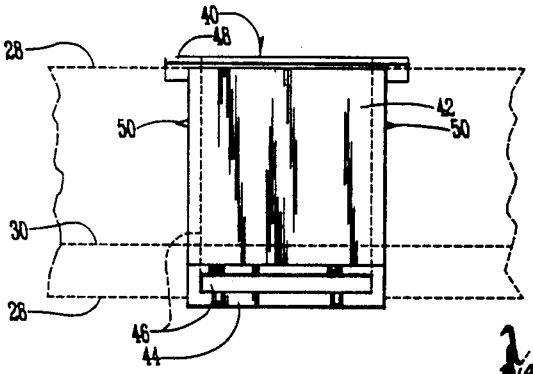
FIG. 4 is a cross sectional view taken along line 4—4 in FIG. 2.

The breather sleeve 40 includes a leg portion 42 which extends parallel to the glazing panel 30 and a leg portion 44 which extends transversely thereof along the adjacent peripheral edge of the glazing panel 30 into the plane of the glazing panel. A passageway 46 extends through the sleeve 40 to provide communication between the air chamber 34 and the outside ambient air through the metal cladding and glazing retainer 36 as seen in FIG. 2.

The breather sleeve 40 includes an outer flange 48 which limits insertion of the sleeve into the U-shaped channel 38. Outwardly extending V-shaped anchors 50 are provided on opposite side edges of the sleeve 40 to lock the sleeve in the U-shaped channel 38 when the sleeve is pressed into the channel. The breather sleeve 40 assures that moisture does not penetrate the wood in the glass stop 28. The metal cladding and glazing retainer 36 assures that dirt and insects do not enter the air chamber 34 through the air passageway 46 of the sleeve 40. The passageway 46 is very narrow further restricting entry of insects.

Figure 7:
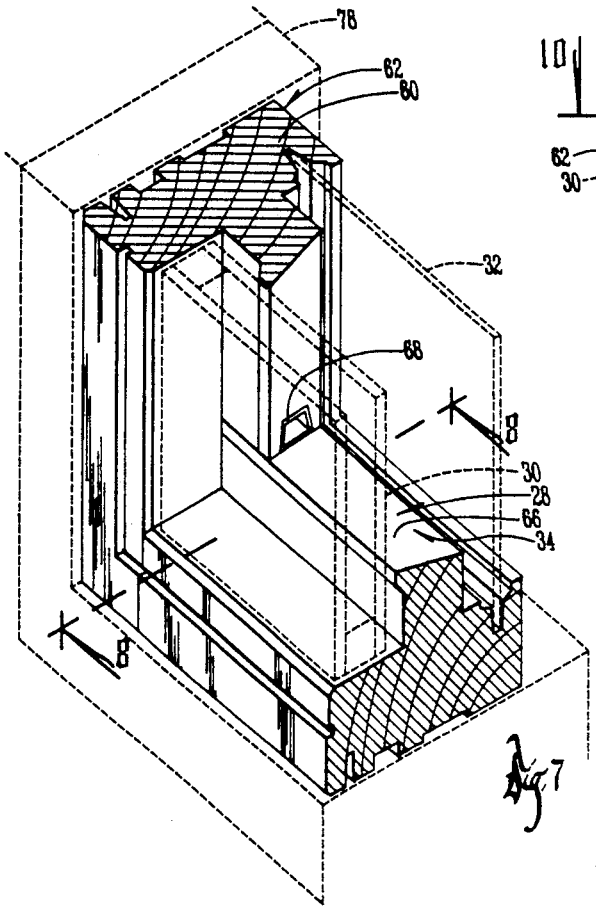
FIG. 7 is a fragmentary perspective view of a breather system in a window panel of an alternate construction wherein the channel is in the end edge of a stile or rail window frame member.
Figure 8:
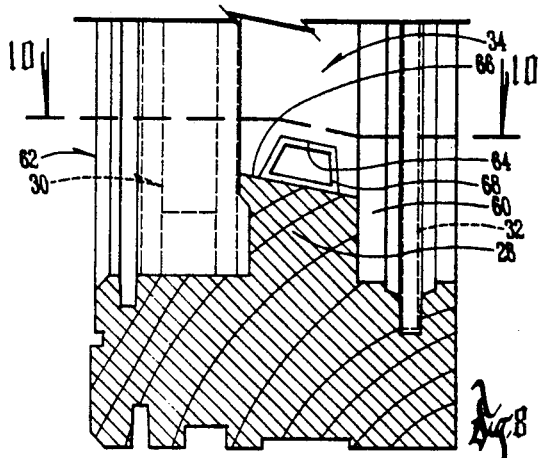
FIG. 8 is a cross sectional view taken along line 8—8 in FIG. 7.
Figure 9:
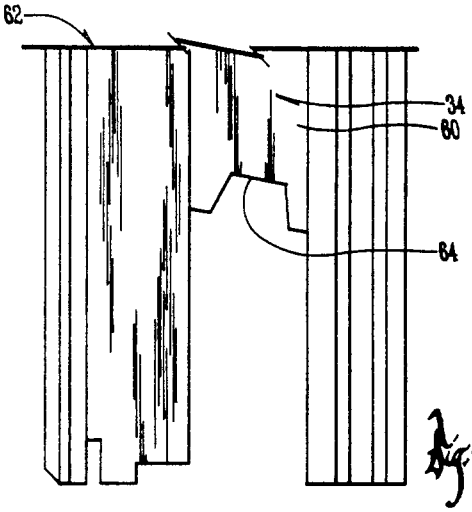
FIG. 9 is a view similar to FIG. 8 but showing only the profile of the stile member having the channel routed into it.
Figure 10:
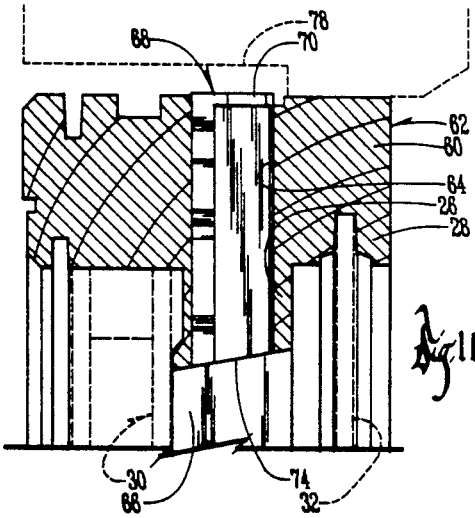
FIG. 10 is a cross sectional view taken along line 10—10 in FIG. 8.
Figure 11:
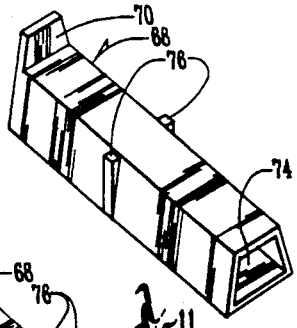
FIG. 11 is a perspective view of a breather sleeve.
Figure 12:
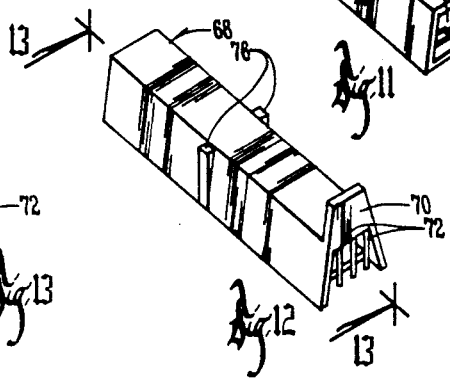
FIG. 12 is a perspective view of the breather sleeve of FIG. 11 showing it from its opposite end.
Figure 13:
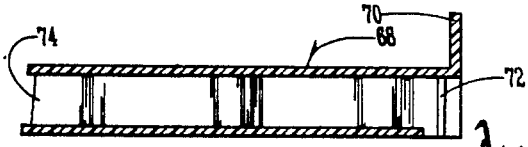
FIG. 13 is a cross sectional view taken along line 13—13 in FIG. 12.

An alternate window arrangement is illustrated in FIGS. 7-13. A stile member 60 forming one side of a window mainframe 62 includes a downwardly facing routed channel 64 as seen in FIG. 9. The open side of the channel is closed by the adjacent upwardly facing face 66 on the rail 28 as seen in FIG. 7. A breather sleeve 68 is press fitted into the channel 64 to provide communication between the insulating air space and the outside ambient air.

Figure 14:
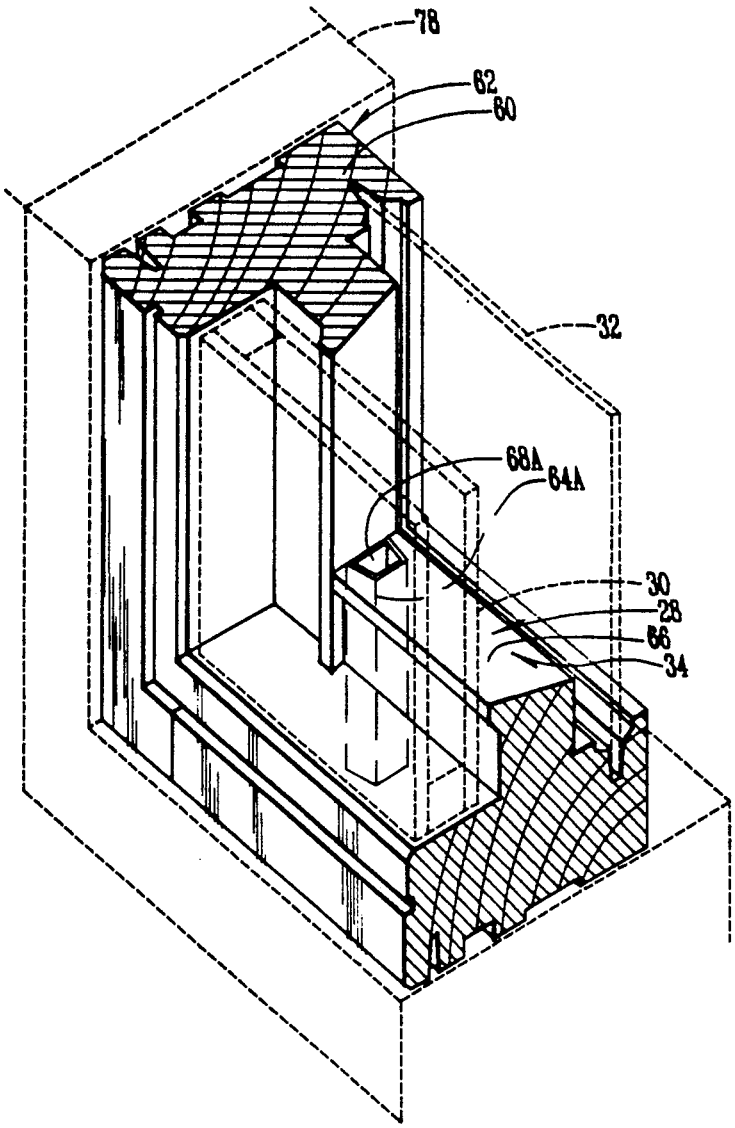
FIG. 14 is a view similar to FIG. 7 but showing the channel in the end edge of the rail window frame member.

In FIG. 14 the breather sleeve 68A is positioned in a channel 64A in the end edge of the rail 28 window frame member. The open end of the channel 64A is closed by the interior face of the adjacent stile member.

Figure 15:
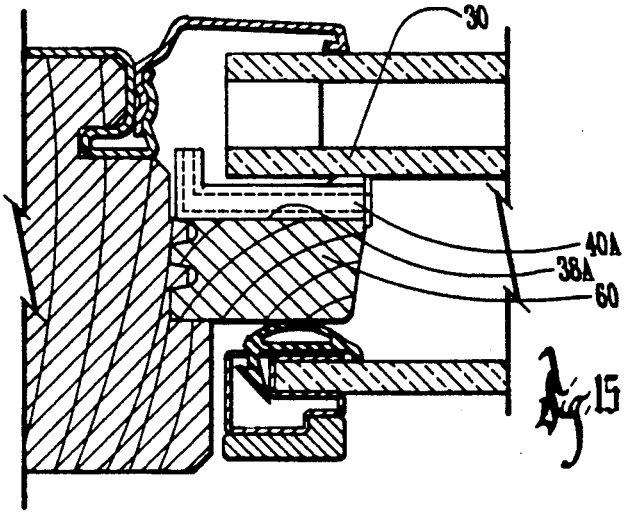
FIG. 15 is a cross-sectional view taken along line 15—15 in FIG. 1.

In FIG. 15 the breather sleeve 40A is positioned in a channel 38A in the face of stile member 60. It is seen that this embodiment is similar to that of FIG. 2, but the channel is in the stile member rather than the rail. In each case the channel is in the face which engages the glazing panel 30.

The breather sleeve 68 is elongated with a stop flange 70 on its outer end and insect restricting fingers 72 extending across a passageway 74 therein. Anchors 76 are provided on opposite sides to lock the breather sleeve 68 in the channel 64. It is seen that the outer end of the breather sleeve 68 opens into a space between the window wall frame 78 and the stile 60. This space is in turn in communication with the outside ambient air.

In operation it is seen that each window may have a breather system that includes a breather sleeve in each corner. The simplified but effective system of this invention is essentially the result of one manufacturing step, routing a channel into stile and/or rail members of the window frame. Abutting stile or rail members or the adjacent glazing panel close the open side of the channel to form a passageway from the interior air chamber to the outside ambient air. Protection against moisture deterioration of the wood is provided through use of plastic sleeves that are press fitted into the channels. Thus it is seen that the need for boring several intersecting holes to form passageways has been eliminated and the alignment problems have been avoided. The appearance of the window is enhanced by the obscure but effective breather system of this invention.

What is claimed is:

1. A window panel comprising,
a perimeter frame having oppositely disposed stile frame members and oppositely disposed rail frame members defining a glazing opening,
a pair of spaced apart glazing panels having an air chamber therebetween positioned in said glazing opening, and
at least one of said rail members having a face in abutting engagement with one of said stile members, said face having a channel formed in it extending from said air chamber to the exterior of said perimeter frame whereby said air chamber is in communication with outside ambient air.

2. The structure of claim 1 wherein said channel includes a breather sleeve extending the length of said channel.

3. The structure of claim 1 wherein said face is further defined as being in an end edge of said one rail member.

4. The structure of claim 3 wherein said one stile member has oppositely facing interior and exterior faces and said face having said channel engages said interior face of said stile member.

5. The structure of claim 4 wherein said channel is U-shaped and open on one side and said interior face of said one stile member closes said open one side of said channel.

6. The structure of claim 5 wherein said closed channel includes a breather sleeve extending the substantial length thereof.

7. The structure of claim 3 wherein said one rail member has oppositely facing interior and exterior faces and said face having said channel engages said interior face of said one rail member.

8. The structure of claim 7 wherein said channel is U-shaped and open on one side and said interior face of said one rail member closes said open one side of said channel.

9. The structure of claim 8 wherein said closed channel includes a breather sleeve extending the substantial length thereof.

10. A window panel comprising,
a perimeter frame having oppositely disposed stile frame members and oppositely disposed rail frame members defining a glazing opening,
a pair of spaced apart glazing panels having an air chamber therebetween positioned in said glazing opening, and
at least one of said rail members having a face in abutting engagement with one of said rail members, said face having a channel formed in it extending from said air chamber to the exterior of said perimeter frame whereby said air chamber is in communication with outside ambient air.

11. The structure of claim 10 wherein said channel includes a breather sleeve extending the length of said channel.

12. The structure of claim 10 wherein said face is further defined as being in an end edge of said one stile member.

13. A window panel comprising,
a perimeter frame having oppositely disposed stile frame members and oppositely disposed rail frame members defining a glazing opening,
a pair of spaced apart glazing panels having an air chamber therebetween positioned in said glazing opening, and
at least one of said rail members having a face in abutting engagement with one of said glazing panels, said face having a channel formed in it extending from said air chamber to the exterior of said perimeter frame whereby said air chamber is in communication with outside ambient air.

14. The structure of claim 13 wherein said channel includes a breather sleeve extending the length of said channel.

15. The structure of claim 13 wherein said channel is U-shaped and open on one side and said one glazing panel closes said open one side of said channel.

16. The structure of claim 13 wherein said face having said channel is further defined by said channel being U-shaped and open on one side and said one of said glazing panels closes said open one side of said channel.

17. The structure of claim 16 wherein said closed channel includes a breather sleeve extending the substantial length thereof.

18. The structure of claim 17 wherein said breather sleeve is L-shaped and includes one leg extending the length of said channel and a second leg extending outwardly from said face closely adjacent an outer peripheral edge of said one glazing panel and into a plane containing said one glazing panel.

19. The structure of claim 13 wherein said one glazing panel closes an open side of said channel to define a passageway for providing said communication between said air chamber and the outside ambient air.

20. The structure of claim 19 wherein aerated metal facing and retaining means are positioned on and in engagement with the side of said one glazing panel opposite said channel in said face thereby obscuring the presence of said channel and connecting said one glazing panel to said one rail member.

21. A window panel comprising,
a perimeter frame having oppositely disposed stile frame members and oppositely disposed rail frame members defining a glazing opening, a pair of spaced apart glazing panels having an air chamber therebetween positioned in said glazing opening, and at least one of said rail members having a face in abutting engagement with one of said glazing panels, said face having a channel formed in it extending from said air chamber to the exterior of said perimeter frame whereby said air chamber is in communication with outside ambient air.

22. The structure of claim 21 wherein said channel includes a breather sleeve extending the length of said channel.

23. The structure of claim 21 wherein said channel is U-shaped and open on one side and said one glazing panel closes said open one side of said channel.

24. The structure of claim 21 wherein said face having said channel is further defined by said channel being U-shaped and open on one side and said one of said glazing panels closes said open one side of said channel.

25. The structure of claim 24 wherein said closed channel includes a breather sleeve extending the substantial length thereof.

26. The structure of claim 25 wherein said breather sleeve is L-shaped and includes one leg extending the length of said channel and a second leg extending outwardly from said face closely adjacent an outer peripheral edge of said one glazing panel and into a plane containing said one glazing panel.

27. The structure of claim 21 wherein said one glazing panel closes an open side of said channel to define a passageway for providing said communication between said air chamber and the outside ambient air.

28. The structure of claim 27 wherein aerated metal facing and retaining means are positioned on and in engagement with the side of said one glazing panel opposite said channel in said face thereby obscuring the presence of said channel and connecting said one glazing panel to said one rail or stile member.

* * * * *